US007063729B2

(12) United States Patent
Valentine et al.

(10) Patent No.: US 7,063,729 B2
(45) Date of Patent: Jun. 20, 2006

(54) LOW-EMISSIONS DIESEL FUEL

(75) Inventors: James M. Valentine, Fairfield, CT (US); Barry N. Sprague, Bethlehem, CT (US); Jeremy D. Peter-Hoblyn, Cornwall (GB)

(73) Assignee: Clean Diesel Technologies, Inc., Stamford, CT (US)

( * ) Notice: Subject to any disclaimer, the term of this patent is extended or adjusted under 35 U.S.C. 154(b) by 256 days.

(21) Appl. No.: 10/290,798

(22) Filed: Nov. 8, 2002

(65) Prior Publication Data

US 2003/0126789 A1 Jul. 10, 2003

Related U.S. Application Data

(63) Continuation of application No. PCT/US01/14789, filed on May 8, 2001.

(60) Provisional application No. 60/202,807, filed on May 9, 2000.

(51) Int. Cl.

| | |
|---|---|
| ***C10L 1/30*** | (2006.01) |
| ***C10L 10/02*** | (2006.01) |
| ***C10L 10/04*** | (2006.01) |
| ***C10L 10/06*** | (2006.01) |

(52) U.S. Cl. ..... 44/354; 44/358; 44/362; 44/363; 44/364; 60/274

(58) Field of Classification Search ..... 44/354, 44/358, 362, 363, 364; 60/274
See application file for complete search history.

(56) References Cited

U.S. PATENT DOCUMENTS

| | | | | |
|---|---|---|---|---|
| 4,891,050 | A | 1/1990 | Bowers et al. | 44/67 |
| 5,034,020 | A | 7/1991 | Epperly et al. | 44/358 |
| 5,266,083 | A | 11/1993 | Peter-Hoblyn et al. | 44/358 |
| 5,501,714 | A * | 3/1996 | Valentine et al. | 44/358 |
| 5,743,922 | A | 4/1998 | Peter-Hoblyn et al. | 44/301 |
| 6,003,303 | A | 12/1999 | Peter-Hoblyn et al. | 60/274 |

* cited by examiner

*Primary Examiner*—Cephia D. Toomer
(74) *Attorney, Agent, or Firm*—Thaddius J. Carvis

(57) ABSTRACT

A low-emissions diesel fuel comprises fungible aviation kerosene grade 55, 50–300 ppm detergent, 25–500 ppm lubricity additive and a bimetallic, fuel soluble platinum and cerium fuel borne catalyst (e.g., 0.1–2.0 ppm platinum COD and 5–20 ppm cerium oleate). The fuel can be used as is or in the form of an emulsion. A method of reducing the emissions of pollutants from a diesel engine, comprising running the engine on a fuel as defined. Retarding engine timing can further reduce $NO_x$ and the use of a diesel particulate filter and/or diesel oxidation catalyst can provide further reductions in carbon monoxide, unburned hydrocarbons and particulates.

11 Claims, No Drawings

LOW-EMISSIONS DIESEL FUEL

PRIORITY CLAIM

This application is a continuation and claims priority to PCT Application Ser. No. PCT/US01/14789, filed May 8, 2001, which in turn claims priority to U.S. Provisional Application Ser. No. 60/202,807, filed May 9, 2000.

BACKGROUND OF THE INVENTION

The invention concerns a new low-emissions diesel fuel based on a base fuel designed for use in jet engines and modified for use in diesel engines, especially of the type used to power buses in metropolitan areas where emissions are of special concern.

Efforts are being made in many jurisdictions to reduce the emissions of regulated pollutants like unburned hydrocarbons, carbon monoxide, nitrogen oxides ($NO_x$) and particulates. The technologies have included those that modify the combustion conditions and fuels, known as primary measures, and those that treat the exhaust after combustion, known as secondary measures. When effective primary measures are employed, the secondary measures can still be employed to achieve further reductions.

There is a need for a new low-emissions fuel for use in diesel engines to reduce emissions of one or more regulated pollutants.

SUMMARY OF THE INVENTION

The invention provides a new low-emissions fuel for use in diesel engines and a method of reducing pollutant emissions from diesel engines. The diesel fuel of the invention and its use in diesel engines is described below.

Many of the preferred aspects of the invention are described below. Equivalent compositions are contemplated.

DESCRIPTION OF THE INVENTION

The invention provides a new diesel fuel comprised of a base fuel, a lubricity additive, a detergent and a bimetallic platinum and cerium fuel additive.

The invention enhances diesel operation through the use of a low-emissions diesel fuel comprising fungible aviation kerosene, detergent, lubricity additive and a bimetallic, fuel soluble platinum and cerium fuel borne catalyst. In a preferred form, the low-emissions diesel fuel will comprise fungible aviation kerosene grade 55, 50–300 ppm detergent, 25–500 ppm lubricity additive and as the fuel borne catalyst a combination of 0.01–2.0 ppm of a fuel-soluble platinum composition and 2–20 ppm cerium supplied as a fuel soluble cerium composition.

The preferred detergent comprises polyolefin amide alkyleneamine (about 65–80%) and the remainder petroleum distillate Equivalents which have the same essential function can also be employed. One preferred form is available from Texaco as TFA-4690-C, at concentrations of from about 50 to 300 ppm in fuel, more narrowly from 75 to 150 ppm, e.g., about 100 ppm, for which they provide the following analysis.

| Properties | Method | Typical |
|---|---|---|
| Density @ 15° C. | D4059 | 0 91-0 94 |
| Nitrogen Content, wt. % | D5291 | 2 3–2.4 |
| Flash, ° C., minimum | D93 | 62 |
| TBN, mg KOH/g | D2896 | 50–60 |
| Kinematic Viscosity, cSt at 40° C. | D445 | 600–850 |

The preferred lubricity additive comprises tall oil fatty acids, available commercially as mixture of fatty acids including oleic, linoleic and the like Equivalents which have the same essential function can also be employed. These fatty acids can also be used in dimerized and trimerized forms or blends thereof.

Dimer acids are high molecular weight dibasic acids produced by the dimerization of unsaturated fatty acids at mid-molecule and usually contain 21–36 carbons. Similarly, trimer acids contain three carboxyl groups and usually 54 carbons. Dimer and trimer acids are generally made by a Diels Alder reaction. This usually involves the reaction of an unsaturated fatty acid with another polyunsaturated fatty acid—typically linoleic acid. Starting raw materials usually include tall oil fatty acids. In addition, it is also known to form dimer and trimer acids by reacting acrylic acid with polyunsaturated fatty acids.

After the reaction, the product usually comprises a small amount of monomer units, dimer acid, trimer acid, and higher analogs. Where the product desired is primarily dimer acid (i e., at least about 85% dimer acid), the reactant product is often merely referred to as dimer acid. However, the individual components can be separated to provide a more pure form of dimer acid or trimer acid by itself. Suitable dimer acids for use in this invention include Westvaco Diacid 1550, commercially available from Westvaco Chemicals of Charleston Heights, S.C.; Unidyme 12 and Unidyme 14, commercially available from Union Camp Corporation of Dover, Ohio, Empol 1022, commercially available from Henkel Corporation of Cincinnati, Ohio; and Hystrene 3695, commercially available from Witco Co. of Memphis, Tenn.

In addition, blends of dimer and trimer acids can also he used as the lubricity additive of the present invention. These blends can be formed by combining, dimer and trimer acids, or can comprise the reaction product from the formation of the dimer acid, which can contain substantial amounts of trimer acid. Generally, blends comprise about 5% to about 80% dimer acid. Specific blends include a blend of about 75% dimer acid and about 25% trimer acid, commercially available as Hystrene 3675, a blend of 40% dimer acid and 60% trimer acid, commercially available as Hystrene 5460, and a blend of about 60% dimer acid and about 40% trimer acid, all commercially available from Witco Co. of Memphis, Tenn.

One preferred form of lubricity additive is available from Texaco as TFA-4769, at concentrations of from about 25 to 500 ppm, e.g., about 50–150 ppm, for which they provide the following analysis:

| Properties | Method | Typical |
|---|---|---|
| Specific Gravity, 60/60° F. | D1298 | 0.91 |
| Pounds/Gallon, 60° F. | Calculated | 7 54 |
| Flash, ° F., minimum | D93 | 142 |
| Kinematic Viscosity, cSt at 40° C. | D445 | 17.85 |

The base fuel comprises a commercially-available jet fuel. It can be purchased from Colonial Pipeline Company as "fungible aviation kerosene grade 55" Equivalents which have the same essential function and those varying compositionally by up to 15%, preferably by less than 5%, can also be employed. It is characterized by the following average analysis:

| | ASTM Test | |
|---|---|---|
| Parameter | Method | Value |
| Cetane Number | D-613 | 50 4 |
| Hydrocarbon | D-1319 | |
| Aromatics, vol % | | 15.3 |
| Olefins, vol % | | 1 8 |
| Saturates, vol % | | 82 9 |
| Flash Point (° F.) | D-93 | 138 |
| API Gravity | D-4052 | 44.4 |
| Specific Gravity | | 0 8045 |
| Viscosity, 40° C. (cSt) | D-445 | 1 46 |
| Sulfur (weight %) | D-2622 | 0 0334[1] |
| ppm | | 334 |
| Heat of Combustion, | | |
| Gross (BTU/Pound) | D-240 | 19794 7 |
| Net (BTU/Pound) | | 18,519.4 |
| Pour Point (° C.) | D-97 | −48 |
| Cloud Point (° C.) | D-2500 | −45 |
| Cetane index (calculated) | D-976 | 42 minimum, 48 test |
| Simulated Distillation | D-2887 | |
| (° C.) | IBP | 119 7 |
| | 5 | 156.7 |
| | 10 | 167.2 |
| | 15 | 173 8 |
| | 20 | 180 8 |
| | 30 | 194 3 |
| | 40 | 203 6 |
| | 50 | 215 3 |
| | 60 | 226 2 |
| | 70 | 235 7 |
| | 80 | 250 2 |
| | 90 | 265 1 |
| | 95 | 276 3 |
| | FBP | 304 7 |

[1]Lower sulfur forms of this formulation. as low as 5 to 30 ppm sulfur. can provide further advantages and are included Among the specific fuel-soluble cerium compounds are cerium III acetylacetonate, cerium III naphthenate, and cerium octoate and other soaps such as stearate, neodecanoate, and octoate (2-ethylhexoate). Many of the cerium compounds are trivalent compounds meeting the formula: $Ce(OOCR)_3$ wherein R=hydrocarbon, preferably $C_2$ and $C_{22}$, and including aliphatic, alicyclic, aryl and alkylaryl. The cerium is preferred at concentrations of 2 to 20 ppm, more narrowly 4–15 ppm, cerium w/v, i.e., weight of cerium metal in mg to volume of fuel in liters. Preferably, the cerium is supplied as cerium hydroxy oleate propionate complex (40% cerium by weight). Preferred levels are toward the lower end of this range.

Any of the fuel-soluble platinum group metal compositions, e.g, 1,5-cyclooctadiene platinum diphenyl (platinum COD), described in U.S. Pat. No. 4,891,050 to Bowers, et al, U.S. Pat. No. 5,034,020 to Epperly, et al, and U.S. Pat. No. 5,266,083 to Peter-Hoblyn, et al, can be employed as the platinum source. Other suitable platinum group metal catalyst compositions include commercially-available or easily-synthesized platinum group metal acetylacetonates, platinum group metal dibenzylidene acetonates, and fatty acid soaps of tetramine platinum metal complexes, e.g., tetramine platinum oleate. The platinum group metal is preferred at concentrations of 0 01–2.0 ppm platinum w/v, i.e., weight of platinum group metal in mg per volume of fuel in liters. Preferred levels are toward the lower end of this range, e.g., 0.1–0.5 ppm. Platinum COD is the preferred form of platinum for addition to the fuel.

The low-emissions diesel fuel of the invention, comprising a fungible aviation kerosene grade 55, 50–150 ppm detergent, 25–500 ppm lubricity additive and 0.1–2.0 ppm platinum COD and 5–20 ppm cerium oleate, can improve engine operation in terms of reducing emissions, while maintaining power. Retarding engine timing, e.g., from 2 to 6°, can further reduce $NO_x$ and the use of a diesel particulate filter and/or diesel oxidation catalyst can provide further reductions in carbon monoxide, unburned hydrocarbons and particulates.

The aviation kerosene in the low-emissions fuel according to the invention can be employed as an emulsion with water, wherein the aviation kerosene is emulsified with water, the water comprising from 1 to 30% water based on the weight of the aviation kerosene. In the preferred forms, the emulsion will be predominantly of the water-in-oil type and will preferably contain surfactants, lubricity additives and/or corrosion inhibitors in addition to the other components mentioned above. A discussion of suitable emulsion forms and additives is found in U.S. Pat. No. 5,743,922. An emulsion of the water-in-oil type typically provides about 1% $NO_x$ reduction for each 1% water added. The combination of technologies will provide emissions reductions greater than either alone. The platinum-cerium FBC is optional. The fuel thus formed can be used with timing changes, EGR, oxidation catalysts or particulate filters for enhanced emissions control.

The term "diesel particulate filter" is meant to refer to those devices known in the art as exhaust gas filters that reduce particulate emissions by trapping a portion of the particulates within a complex internal structure. They must be regenerated or replaced as deposits will accumulate. The fuel borne catalyst described above, when used with the base fuel as also described—forming the fuel of the invention—enables very reduced emissions with enhanced filter operation.

The term "diesel oxidation catalyst" is meant to refer to those devices known in the art as exhaust gas treatment catalysts that reduce particulate, hydrocarbon and carbon monoxide emissions by causing contact with catalyzed surfaces in lieu of trapping particulates as done in the diesel particulate filters. The fuel borne catalyst described above, when used with the base fuel as also described—forming the fuel of the invention—enables very reduced emissions with enhanced oxidation catalyst operation.

Retarding engine timing, e.g., by from about 2 to about 6°, is a known procedure for reducing $NO_x$, unfortunately it will by itself cause pollutant generation due to poor combustion. This tradeoff has been troubling the art since emissions control became important. It is an advantage of the invention, that both reduced $NO_x$ and other pollutants can be achieved by employing the fuel of the invention in combination with one or more of the above techniques and/or exhaust gas recirculation wherein a portion of the exhaust gas is intermixed with combustion air.

The following Examples are provided to further illustrate and explain a preferred form of the invention and are not to be taken as limiting in any regard. Unless otherwise indicated, all parts and percentages are by weight.

EXAMPLE 1

This example describes the preparation of a low-emissions diesel fuel according to a preferred aspect of the invention. A fuel is blended using the Colonial Pipeline Company fungible aviation kerosene grade 55 analyzed above, with 100 ppm of the TFA 4690-C detergent, 225 ppm of the noted Texaco lubricity additive and a fuel borne catalyst (FBC) containing 0.15 ppm platinum supplied as platinum COD and 7 5 ppm cerium supplied as cerium hydroxy oleate propionate complex (solution containing 40% cerium by weight). These ppm values are, again weight of metal in mg per volume of fuel in liters. The fuel was used in a test of a 1998 DDC Detroit Diesel Series 60, 400 hp engine and showed remarkably improved results as compared to a reference on highway No 2 or a CARB ULSD (California Air Resources Board Ultra Low Sulfur Diesel) fuel.

Test data is summarized in the following table, wherein the test results of the FTP transient—composite results are given for the various fuels tested.

| Fuel | Sulfur (ppm) | Emissions (g/bhp-hr) HC | CO | NOx | PM | BSFC (lbs/hp-hr) |
|---|---|---|---|---|---|---|
| 1998 Standard | <500 | 1.3 | 15.5 | 4 0 | 0 10 | NS |
| 2D | 450 | 0.15 | 1 13 | 4.05 | 0 075 | 0.398 |
| CARB ULSD | 50 | 0.08 | 0 96 | 3 72 | 0.063 | 0.392 |
| CARB ULSD + FBC | 50 | 0.10 | 0.85 | 3.78 | 0 053 | 0.391 |
| Example 1 Fuel | 300 | 0.13 | 0 84 | 3 66 | 0 050 | 0.397 |

These results are surprising, from the standpoint that the CARB USLD fuel has been the subject of considerable investigation and development, yet does not provide improved results as compared to the invention—even when the FBC catalyst is added to it. Thus, the invention provides a very practical approach to reducing a range of polluting emissions without creating a need for difficult and expensive processing to achieve the ultra low sulfur contents now thought to be essential to particulate control.

The above description is intended to enable the person skilled in the art to practice the invention. It is not intended to detail all of the possible modifications and variations which will become apparent to the skilled worker upon reading the description. It is intended, however, that all such modifications and variations be included within the scope of the invention which is seen in the above description and otherwise defined by the following claims. The claims are meant to cover the indicated elements and steps in any arrangement or sequence which is effective to meet the objectives intended for the invention, unless the context specifically indicates the contrary.

The invention claimed is:

1. A low-emissions diesel fuel comprising fungible aviation kerosene, detergent, lubricity additive and a bimetallic, fuel-soluble platinum group metal and cerium fuel borne catalyst, wherein the cerium is supplied as a fuel soluble hydroxy oleate propionate complex.

2. A low-emissions diesel fuel according to claim 1 comprising fungible aviation kerosene grade 55, 50–300 ppm detergent, 25–500 ppm lubricity additive and as the fuel borne catalyst a combination of 0.01–2.0 ppm of platinum as a fuel-soluble platinum composition and 2–20 ppm cerium.

3. A low-emissions fuel according to claim 1, wherein the platinum is supplied as 1,5-cyclooctadiene platinum diphenyl.

4. A low-emissions fuel according to claim 1, containing 4 to 15 ppm cerium and 0.1 to 1.0 ppm platinum.

5. A low-emissions fuel according to claim 1, wherein the aviation kerosene is emulsified with water, the water comprising from 1 to 30% water based on the weight of the aviation kerosene.

6. A method of reducing the emissions of pollutants from a diesel engine, comprising running the engine on a fuel as defined in claim 1.

7. A method for operating an engine with decreased $NO_x$ comprising retarding engine timing by from 2 to 60° to provide for reduced $NO_x$ and burning a fuel as described in claim 1.

8. A method for operating an engine with decreased emission of unburned hydrocarbons, carbon monoxide and particulate matter: comprising operating the engine by burning a fuel as described in claim 1, thereby producing combustion gases, and passing the gases through a diesel oxidation catalyst and/or a diesel particulate filter.

9. A method for operating an engine with decreased emission of $NO_x$, unburned hydrocarbons, carbon monoxide and particulate matter, comprising: retarding engine timing by from 2 to 60° to provide for reduced $NO_x$ and operating the engine by burning a fuel as described in claim 1, thereby producing combustion gases, and passing the gases through a diesel oxidation catalyst and/or a diesel particulate filter.

10. A method for operating an engine with decreased emission of $NO_x$, unburned hydrocarbons, carbon monoxide and particulate matter, comprising: employing exhaust gas as a portion of combustion air to provide for reduced $NO_x$ and operating the engine by burning a fuel as described in claim 1, thereby producing combustion gases, and passing the gases through a diesel oxidation catalyst and/or a diesel particulate filter.

11. A low-emissions diesel fuel comprises aviation kerosene, detergent, lubricity additive and a bimetallic, fuel-soluble platinum group metal and cerium fuel borne catalyst, wherein the fuel contains 50–300 ppm detergent, 25–500 ppm lubricity additive and as the fuel borne catalyst a combination of 0.01–2.0 ppm of platinum and 2–20 ppm cerium supplied as a fuel soluble cerium hydroxy oleate propionate complex.

* * * * *